US006807815B2

(12) United States Patent
Lee et al.

(10) Patent No.: US 6,807,815 B2
(45) Date of Patent: Oct. 26, 2004

(54) AIR CONDITIONING SYSTEM AND METHOD FOR OPERATING THE SAME

(75) Inventors: Won Hee Lee, Seoul-si (KR); Chang Min Choi, Seoul-si (KR); Yoon Jei Hwang, Seoul (KR); Deok Huh, Kyungki-do (KR); Cheol Min Kim, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/377,779

(22) Filed: Mar. 4, 2003

(65) Prior Publication Data

US 2003/0233837 A1 Dec. 25, 2003

(30) Foreign Application Priority Data

Jun. 19, 2002 (KR) ..... 10-2002-0034365

(51) Int. Cl.[7] ..... F25B 7/00
(52) U.S. Cl. ..... 62/158; 62/175
(58) Field of Search ..... 62/231, 175, 158; 236/1 EA, 49.3

(56) References Cited

U.S. PATENT DOCUMENTS 4,932,220 A * 6/1990 Inoue ..... 62/175
6,370,894 B1 * 4/2002 Thompson et al. ..... 62/158
6,519,957 B2 * 2/2003 Huh et al. ..... 62/175

* cited by examiner

*Primary Examiner*—Harry B. Tanner
(74) *Attorney, Agent, or Firm*—Greenblum & Bernstein, P.L.C.

(57) ABSTRACT

An air conditioning system and a method for operating the air conditioning system, in which a plurality of compressors are simultaneously or selectively operated, based on the difference between a room temperature and a desired temperature generated during a waiting time for re-operation of the compressors. The room temperature varying during the waiting time for the re-operation of the compressors maintained at a stopped state is sensed to determine whether or not an increase in cooling load occurs. Based on the amount of the cooling load, it is determined whether the compressors have to operate simultaneously or selectively. That is, the refrigerant compression capacity of the air conditioning system is determined by reflecting the cooling load caused by a variation in room temperature occurring during the waiting time for re-operation taken until any compressor maintained in a stopped state is re-operated. Accordingly, it is possible to more stably control the room temperature, and to achieve an improvement in the comfortableness of the room atmosphere.

5 Claims, 5 Drawing Sheets

AIR CONDITIONING SYSTEM AND METHOD FOR OPERATING THE SAME

BACKGROUND OF THE INVENTION

1. Field of the Invention

The present invention relates to an air conditioning system and a method for operating the air conditioning system, and more particularly to an air conditioning system and a method for operating the air conditioning system, in which a plurality of compressors are simultaneously or selectively operated, based on the difference between a room temperature and a desired temperature generated during a waiting time for re-operation of the compressors.

2. Description of the Related Art

Generally, an air conditioner is an appliance in which a refrigerant passes through a compressor, a condenser, an expansion valve, and evaporator to establish a cooling cycle, thereby cooling a room.

The compressor included in such an air conditioner serves to compress a refrigerant circulating through an indoor or outdoor heat exchanger. In the case of a particular air conditioner, a direction change valve is also provided, in addition to such a compressor. The direction change valve is connected with a plurality of indoor and outdoor heat exchangers via refrigerant conduits, while being connected between the inlet and outlet of the compressor so as to change the circulating direction of a refrigerant, thereby causing the indoor heat exchangers to operate as warming or cooling units. In this case, therefore, it is possible for the air conditioner to more appropriately cope with both the environment of the room to be cooled and a desire of the user.

That is, the outdoor and indoor heat exchangers serve as a condenser and an evaporator, respectively, in a mode for cooling a room, while serving as an evaporator and a condenser, respectively, in a mode for warming the room. That is, the functions of the inner and outer heat exchangers are reversed in accordance with a change of the operating mode. Thus, different heat transfer cycles are established in accordance with different operating modes, respectively.

Such an air conditioner capable of performing both the cooling and warming functions is referred to as a "heat pump type air conditioner". However, the following description relating to the present invention and related art will be given without limitation to any particular kind of air conditioners.

Generally, conventional air conditioning systems establish a cooling cycle adapted to condition indoor air, as shown in FIG. 1. Now, the conventional cooling cycle will be described in conjunction with FIG. 1.

The conventional cooling cycle includes a plurality of compressors 10 adapted to change a refrigerant from a low-temperature and low-pressure gaseous state into a high-temperature and high-pressure gaseous state. The compressors 10 are simultaneously or selectively operated to vary the capacity of the compressed refrigerant. In the illustrated case, two compressors, that is, first and second compressors 11 and 12, are used. In this case, both the first and second compressors 11 and 12 may operate simultaneously, or the first compressor 11 may operate while the second compressor 12 is maintained in a stopped state.

A direction change valve 20 serves to send, to an outdoor heat exchanger 50, a refrigerant emerging from the compressors 10 in a cooling mode, whereas it sends the refrigerant to indoor heat exchangers 30 in a warming mode. Thus, the direction change valve 20 changes the circulating direction of the refrigerant. The direction change valve 20 is used only in the case of heat pump type air conditioners having a cooling or warming function in order to establish a cooling or warming cycle in accordance with a flow of compressed refrigerant. In other words, general air conditioners for cooling purposes do not need such a direction change valve.

The outdoor heat exchanger 50 serves as condensing means for condensing the high-temperature and high-pressure gaseous refrigerant into a liquid state. This outdoor heat exchanger 50 constitutes an outdoor unit 99, along with an outdoor blower (not shown) installed at one side of the outdoor heat exchanger 50, and adapted to blow air toward the heat exchanger, thereby increasing the heat exchange efficiency of the heat exchanger. The outdoor blower includes an outdoor fan (not shown) and a motor (not shown).

The liquid refrigerant condensed by the condensing means is expanded into a low-temperature and low-pressure refrigerant of two phases, that is, gaseous and liquid phases in a mixed state, by an expansion member 40.

Each indoor heat exchanger 30 serves as evaporating means for externally absorbing heat, thereby changing the two-phase refrigerant into a gaseous state. An indoor blower (not shown) is installed at one side of each indoor heat exchanger 30 to discharge cooled air into a room. The indoor blower includes a motor 31 and an indoor fan 32. The indoor blower constitutes an indoor unit 39, along with the indoor heat exchanger 30. Thus, a cooling cycle of compression, condensation, expansion and evaporation is established.

In order for the cooling cycle of the above mentioned air conditioner to have a high efficiency, two compressors having different capacities, that is, the first and second compressors 11 and 12, are used. In the illustrated case, the first compressor 11 has a refrigerant compression capacity of 40%, whereas the second compressor 11 has a refrigerant compression capacity of 60%.

In the case of a high cooling load, both the first and second compressors are simultaneously operated in order to achieve a refrigerant compression rate of 100%. On the other hand, in the case of a low cooling load, only the first compressor is selectively operated to achieve a refrigerant compression rate of 40%. Thus, the refrigerant compression capacity of the air conditioner is variable.

FIG. 2 is a graph showing the operating states of a plurality of compressors included in a conventional air conditioning system. In the graph, the X-axis represents a compressor operation time, and the Y-axis represents a refrigerant compression capacity or compressor operation rate. FIG. 3 is a flow chart illustrating a conventional method for operating the conventional air conditioning system. Now, the conventional method for operating the conventional air conditioning system will be described in conjunction with the case in which two compressors are used.

First, the user sets a desired temperature after turning on the air conditioner (Step L1).

In order to reduce the temperature of a room to the set desired temperature, both the compressors are simultaneously operated two times (C1 and C2). That is, the room temperature reaches the desired temperature by eliminating the cooling load in the room by the 100% refrigerant compression capacity (Step L2).

When the room temperature reaches the desired temperature, the second compressor is stopped. That is, only the first compressor is selectively operated to carry out a cooling operation using a cooling cycle with a refrigerant compression capacity of 40% (C3) (Step L3).

The air conditioner senses the cooling load after the cooling operation. When the air conditioner senses elimination of the cooling load, it maintains the operating condition of the first compressor (C3). On the other hand, when the cooling load has not been eliminated yet, both the first and second compressors are operated (C4) so that the room temperature rapidly reaches a desired temperature (Step L4).

In accordance with the above mentioned operating method, the conventional air conditioning system operates to vary the refrigerant compression capacity of the compressors depending on the sensed cooling load under the condition in which one or more of the compressors are selectively operated. In order to re-operate any compressor maintained in a stopped state, however, a certain time is generally taken until pressure equilibrium is obtained between the refrigerant inlet and outlet of the compressor. This time is called a "waiting time for re-operation".

In conventional cases, in particular, conventional heat pump type air conditioners, the compression capacity of each compressor is determined without taking into consideration the amount of a cooling or warming load generated during the waiting time for re-operation. That is, any abrupt increase in cooling or warming load occurring during the waiting time for re-operation is not reflected upon controlling of compression capacity. For this reason, as such a cooling or warming load generated during the waiting time for re-operation is not eliminated, an abrupt increase or decrease in room temperature is caused. As a result, a degradation in the comfortableness of the room atmosphere occurs.

SUMMARY OF THE INVENTION

Therefore, the present invention has been made in view of the above mentioned problems involved with the related art, and an object of the invention is to provide an air conditioning system and a method for operating the air conditioning system, which are adapted to reflect, upon controlling the refrigerant compression capacity of a plurality of compressors, the amount of a cooling load generated during a waiting time for re-operation taken until each compressor maintained in a stopped state is re-operated by sensing the temperature of a room to be cooled, determining whether or not the difference between the sensed room temperature and a desired temperature set by the user is less than a predetermined value, and determining, based on the result of the determination, whether the compressors have to be simultaneously or selectively operated, thereby being capable of accurately determining the cooling load, and accurately controlling the operation of the compressors, and thus, achieving an improvement in the comfortableness of the room atmosphere.

In accordance with one aspect, the present invention provides an air conditioning system comprising: an air conditioner for establishing a cooling cycle adapted to sequentially perform compression, condensation, expansion and evaporation functions, and eliminating a cooling load in a room by the cooling cycle, thereby conditioning the atmosphere of the room; and a control unit for controlling an operation state of a compressor unit adapted to perform the compression function, in order to vary a refrigerant compression capacity of the compressor unit in accordance with the cooling load.

In accordance with another aspect, the present invention provides a method for operating an air conditioning system comprising the steps of: (A) simultaneously operating a plurality of compressors included in the air conditioning system until a temperature of a room to be cooled reaches a desired temperature; (B) stopping the operation of the compressors when the room temperature reaches the desired temperature, and sensing a temperature of the room after a waiting time taken until the stopped compressors are re-operated; and (C) simultaneously or selectively operating the compressors in accordance with a temperature difference between the room temperature sensed at the step (B) and the desired temperature.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Now, preferred embodiments of the present invention will be described in detail with reference to the annexed drawings.

Figure 1:
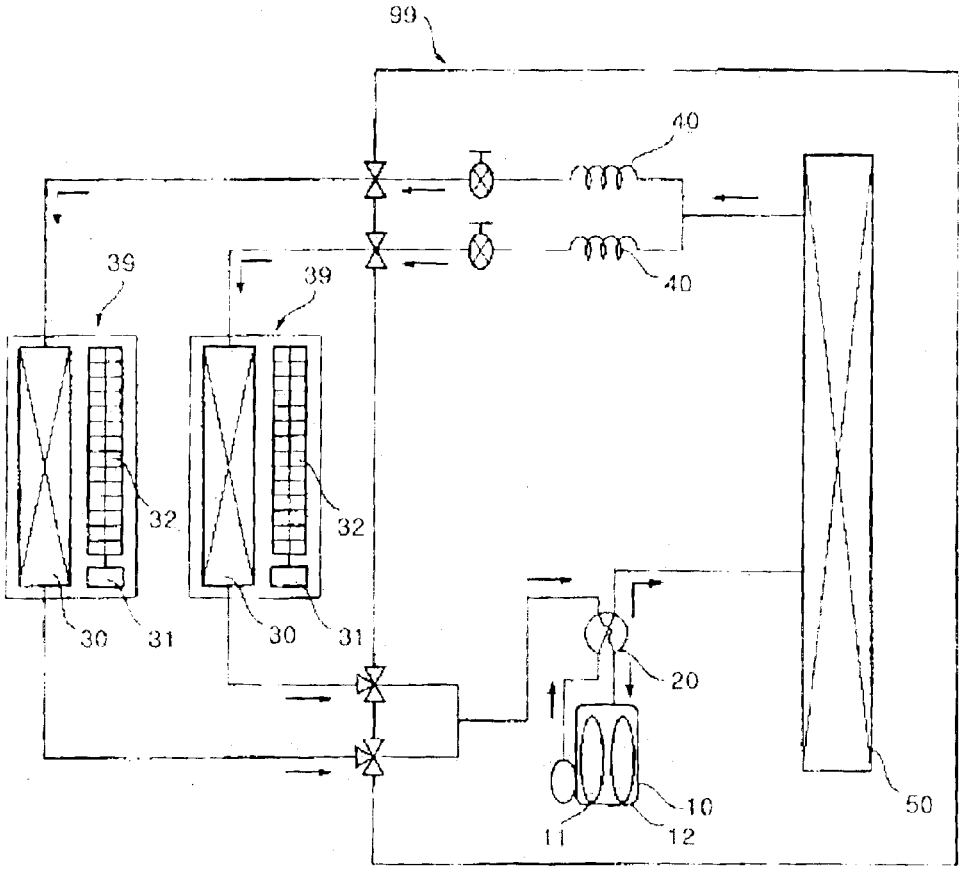
FIG. 1 (Prior Art)
FIG. 1 is a flow chart illustrating a cooling cycle established by a general air conditioning system.
Figure 2:
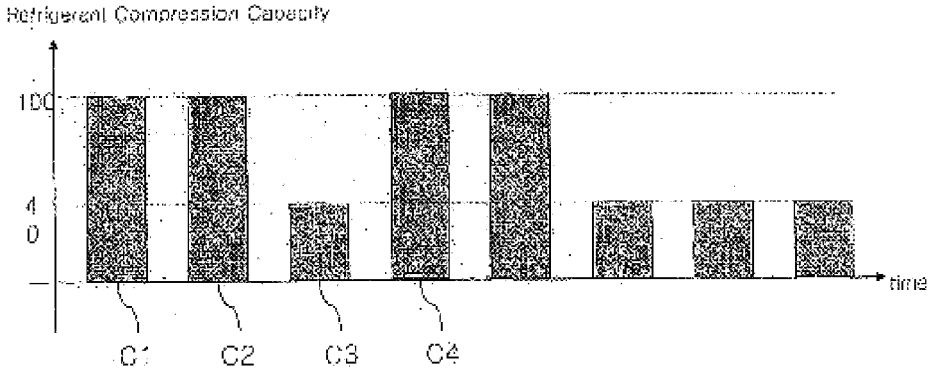
Fig. 2 (Prior Art)
FIG. 2 is a graph showing the operating states of a plurality of compressors included in a conventional air conditioning system.
Figure 3:
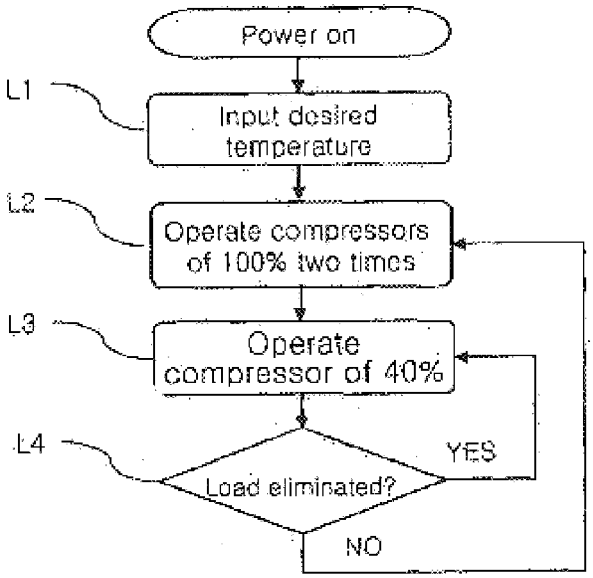
Fig. 3 (Prior Art)
FIG. 3 is a flow chart illustrating a conventional method for operating the conventional air conditioning system.
Figure 4:
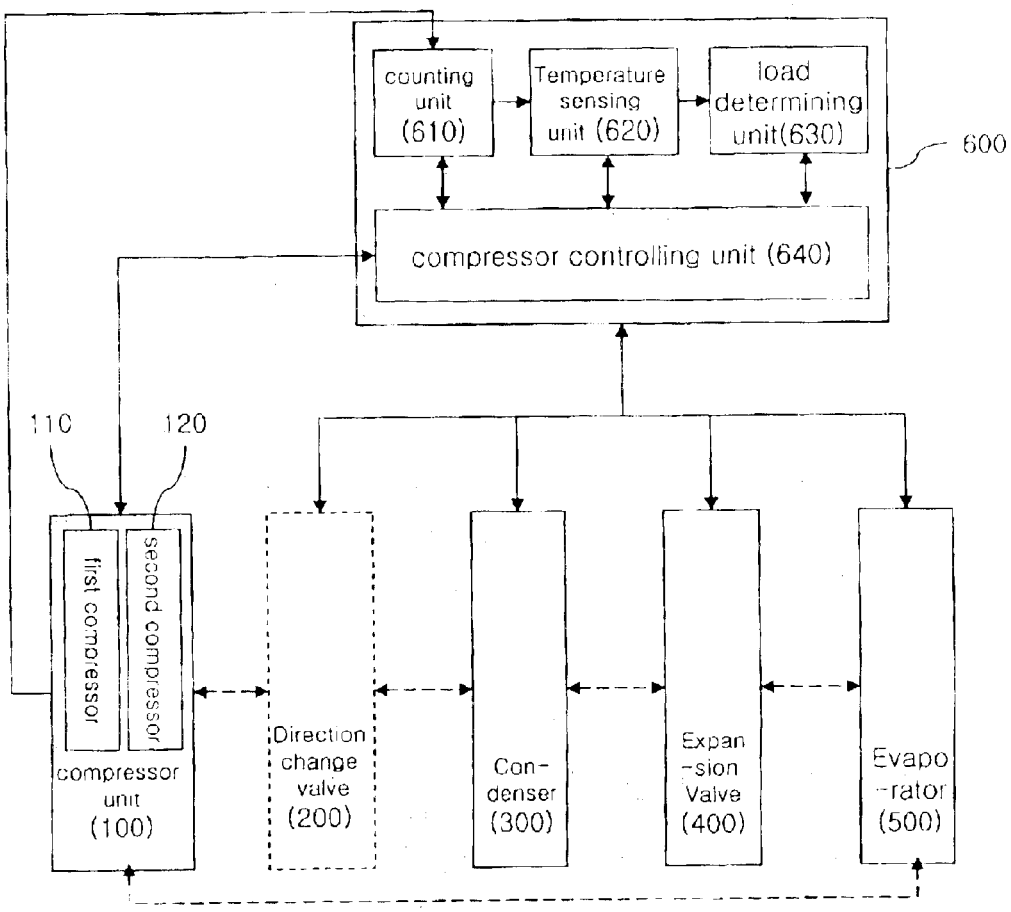
FIG. 4 is a block diagram illustrating the configuration of an air conditioning system according to the present invention.

The basic configuration of an air conditioning system according to the present invention is similar to that of the conventional system described with reference to FIG. 1. Accordingly, the air conditioning system of the present invention will be described in detail with reference to a schematic block diagram of FIG. 4. In FIG. 4, solid-line arrows represent flows of control signals transmitted from a control unit to respective portions of the air conditioning system, and phantom-line arrows represent refrigerant flows, respectively.

A compressor unit 100 sucks a gaseous refrigerant evaporated in an evaporator 500, and compresses the sucked refrigerant. As the refrigerant is compressed, it is changed into a high pressure state in which the molecular kinetic energy of the gaseous refrigerant increases, thereby causing increased molecular collisions. In accordance with such molecular collisions, the gaseous refrigerant increases in temperature, so that it is changed into a high-temperature and high-pressure state. Thus, the gaseous refrigerant can be easily liquefied because the number of molecules per volume thereof increases.

In accordance with the present invention, the compressor unit 100 comprises a first compressor 110 and a second compressor 120. Each of the compressors 110 and 120 has a compression capacity set, by the manufacturer, to compress a predetermined percentage of the total refrigerant capacity. In the following description, an air conditioner is described, in which the first compressor 110 is configured to compress 40% of the total refrigerant capacity, and the second compressor 120 is configured to compress 60% of the total refrigerant capacity in accordance with an embodiment of the present invention. However, the compression capacity of each compressor is not limited to the value set in the embodiment of the present invention.

A condenser 300 removes heat from the high-temperature and high-pressure gaseous refrigerant emerging from the compressor unit 100, thereby liquefying the gaseous refrigerant. That is, the condenser 300 produces a liquid refrigerant of a medium-temperature and high-pressure state.

An expansion valve 400 expands the medium-temperature and high-pressure liquid refrigerant, thereby reducing the pressure of the refrigerant. In accordance with this function of the expansion valve 400, the liquid refrigerant is changed into a low-temperature and low-pressure state. This refrigerant is evaporated as it absorbs heat from the air in a room to be cooled. Accordingly, the liquid refrigerant is changed into a gaseous refrigerant of a low-temperature and low-pressure state while cooling the room.

The control unit, which is denoted by the reference numeral 600, controls the compressor unit 100, condenser 300, expansion valve 400, and evaporator 500. In particular, the control unit 600 controls the operation of the compressor unit 100 in order to control the refrigerant compression capacity in accordance with the cooling load.

Where the air conditioner is of a heat pump type added with a warming function, it is additionally provided with a direction change valve 200 indicated by a phantom line in FIG. 4. In this case, the control unit 600 controls the direction change valve 200 in order to control the circulating direction of the refrigerant in accordance with the operation mode, that is, a cooling or warming mode.

In the air conditioner in which the compressor unit 100 includes a plurality of compressors, the control unit 600 is configured to control the operation state of the compressor unit 100 while taking into consideration the amount of a cooling load generated during a waiting time for re-operation of any compressor maintained in a stopped state. That is, the control unit 600 includes a counting unit 610 for sensing the point of time when the operation of the compressor unit 100 is stopped, and counting a waiting time for re-operation taken until the stopped compressor unit 100 is re-operated, a temperature sensing unit 620 for sensing the temperature of the room after the re-operation waiting time counted by the counting unit 610, a load determining unit 630 for determining the amount of the cooling load generated during the re-operation waiting time, based on a temperature difference between the room temperature sensed by the temperature sensing unit and a previously-input desired temperature, and a compressor controlling unit 640 for outputting a control signal making the compressor unit operate in a full operation mode or a selective operation mode in accordance with the amount of the cooling load sensed by the load determining unit 630.

The load determining unit 630 determines whether or not the temperature difference is more than a predetermined value. Where the temperature difference is more than the predetermined value, the load determining unit 630 determines an abrupt increase in cooling load, and outputs a corresponding signal to inform the compressor controlling unit 640 of the cooling load increase. In response to this signal, the compressor controlling unit 640 outputs a full operation control signal to the compressor unit 100 in order to rapidly eliminate the cooling load.

Thus, the compressor controlling unit 640 controls the operation state of the compressor unit 100 while reflecting the amount of the cooling load generated during the waiting time for re-operation of the stopped compressor or compressors, so that the room temperature is maintained within a desired temperature range.

Figure 5:
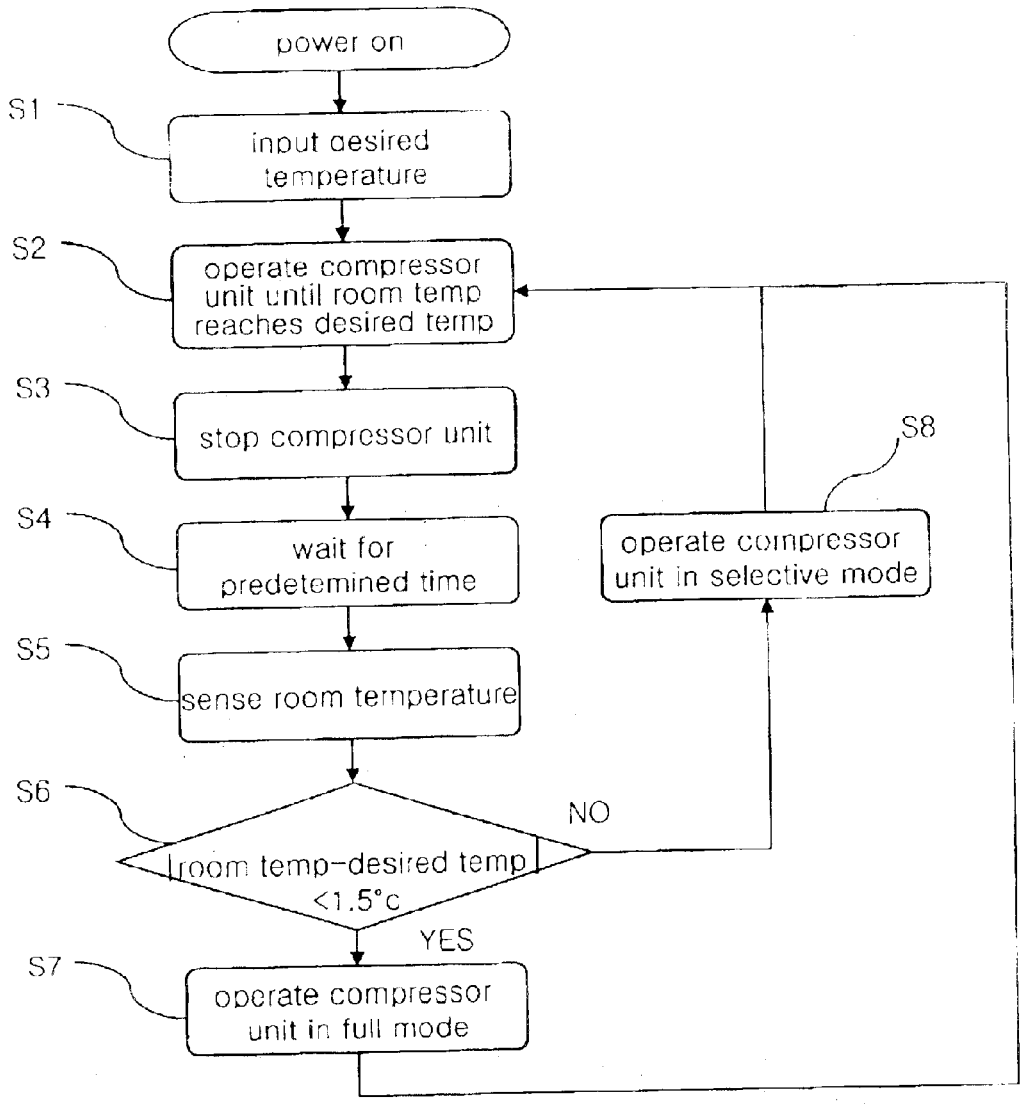
FIG. 5 is a flow chart illustrating a method for operating the air conditioning system in accordance with the present invention.
Figure 6:
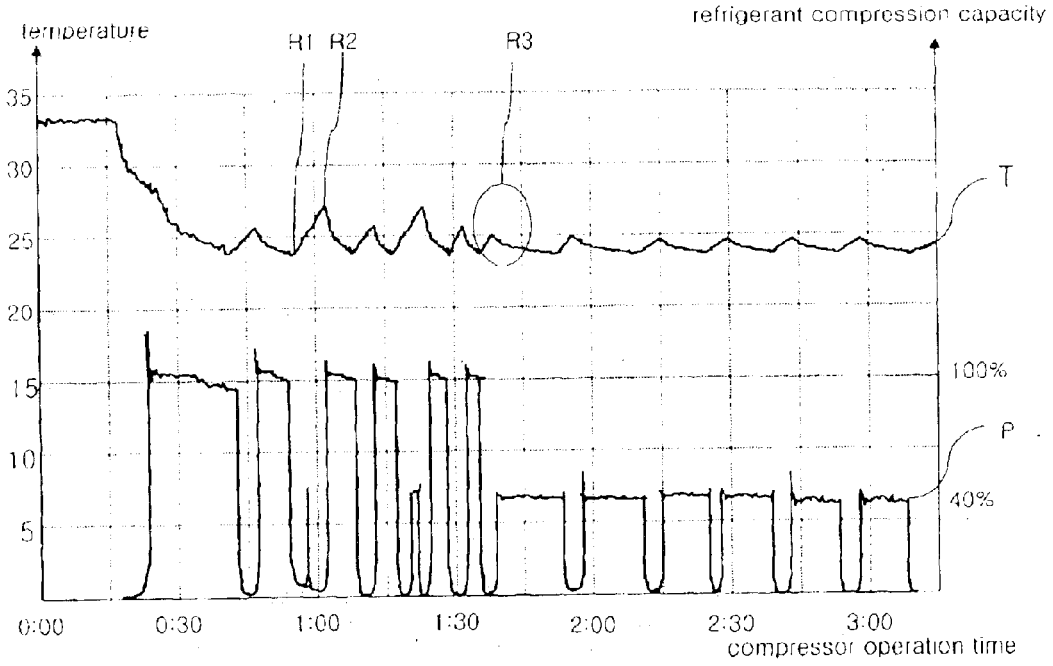
FIG. 6 is a graph depicting a variation in the room temperature controlled by the air conditioning system according to the present invention.

FIG. 5 is a flow chart illustrating a method for operating the air conditioning system in accordance with the present invention. FIG. 6 is a graph depicting a variation in the room temperature controlled by the air conditioning system according to the present invention.

In accordance with the operating method, a desired temperature is first inputted to the air conditioning system in accordance with a key manipulation of the user in an ON state of the air conditioning system (Step S1). A difference between the current room temperature and the inputted desired temperature corresponds to a cooling load to be eliminated by the air conditioning system.

All compressors of the compressor unit 100 are simultaneously operated to rapidly establish a cooling cycle having a refrigerant compression capacity of 100% until the room temperature reaches the desired temperature. That is, the compressor unit 100 operates in a full operation mode (Step S2).

When the room temperature reaches the desired temperature, the compressor unit 100 is stopped to release the cooling cycle (Step S3). Thus, the compressor unit 100 is maintained in a waiting state for a certain time, that is, until the stopped compressor unit 100 re-operates to reestablish the cooling cycle (Step S4). This waiting time is required to obtain a pressure equilibrium between the refrigerant inlet and outlet of the stopped compressor unit 100.

Accordingly, the room temperature is gradually increased in a state in which the compressor unit 100 is in a waiting state after being stopped during a cooling mode. That is, a cooling load is generated. On the other hand, the room temperature is gradually decreased in a state in which the compressor unit 100 is in a waiting state after being stopped during a warming mode. That is, a warming load is generated. Preferably, the waiting state is maintained for 2 to 3 minutes. The temperature sensing unit included in the air conditioning system senses the room temperature during the waiting time in order to sense the amount of a cooling load generated during the waiting time (Step S5).

The control unit 600 calculates the temperature difference between the sensed room temperature and the desired temperature, and determines whether or not the calculated temperature difference is less than a predetermined value (Step S6). In accordance with the illustrated embodiment of the present invention, the predetermined value corresponds to 1.5° C. However, this value may be varied by the manufacturer of the air conditioning system. It will be appreciated that the temperature difference is a positive value in the case of a cooling mode, whereas it is a negative value in the case of a warming mode. Therefore, where the present invention is applied to a heat pump type air conditioning system having both the cooling and warming functions, the temperature difference should be considered to be an absolute value.

Where the calculated temperature difference is less than the predetermined value, the first compressor 110 of the compressor unit 100 is operated to establish a cooling cycle having a refrigerant compression capacity of 40% (Step S7). That is, the compressor unit 100 operates in a selective operation mode. Thus, the room temperature is maintained within an appropriate temperature range.

On the other hand, where the calculated temperature difference is not less than the predetermined value, all compressors of the compressor unit 100 are simultaneously operated in order to rapidly eliminate the generated cooling load. That is, the compressor unit 100 operates in the full operation mode, thereby establishing a cooling cycle having a refrigerant compression capacity of 100% (Step S8). Thus, the room temperature reaches the desired temperature.

In FIG. 6, the X-axis represents a compressor operation time, the left Y-axis represents a room temperature, and the right Y-axis represents a refrigerant compression capacity according to a compressor operation state. A variation in the room temperature T is read on the left Y-axis, whereas a variation in the refrigerant compression capacity P is read on the right Y-axis. The example of FIG. 6 corresponds to the case in which a cooling function associated with a desired temperature of 24° C. is performed.

When the air conditioning system carries out an air conditioning operation by operating the compressor unit 100 two times with a refrigerant compression capacity of 100%, the room temperature reaches a desired temperature, for example, 24° C. (R1). Once the room temperature reaches the desired temperature, the compressor unit 100 is stopped, and waits for re-operation. As the compression of the refrigerant is stopped for a waiting time for the re-operation of the compressor unit 100, the room temperature increases to a higher temperature, for example, 27° C. (R2).

After the waiting time elapses, the control unit 600 senses the room temperature, and determines whether or not the temperature difference between the sensed room temperature and the desired temperature is less than a predetermined value, for example, 1.5° C. Since the temperature difference between the room temperature of 27° and the desired temperature of 24° C. is 3° C., it exceeds the predetermined value of 1.5° C. Accordingly, the control unit 600 outputs a control signal for operating the compressor unit 100 in the full operation mode in order to carry out an air conditioning operation with a refrigerant compression capacity of 100%. In response to the full operation control signal, the compressor unit 100 operates in the full operation mode with a refrigerant compression capacity of 100% until the room temperature reaches the desired temperature.

On the other hand, when the temperature difference between the room temperature sensed after the waiting time and the desired temperature of 24° C. is less then the predetermined value of 1.5° C., the compressor unit 100 operates in a selective operation mode such that the first compressor 110 operates while the second compressor 120 is maintained in a stopped state. That is, the compressor unit 100 operates with a refrigerant compression capacity of 40%. Referring to FIG. 6, it can be seen that the amount of the cooling load generated during any re-operation waiting time after a compressor operation time of 1 minute 30 seconds is less than the predetermined value, so that the compressor unit 100 always operates in the selective operation mode after the compressor operation time.

Although the preferred embodiments of the invention have been disclosed for illustrative purposes, those skilled in the art will appreciate that various modifications, additions and substitutions are possible, without departing from the scope and spirit of the invention as disclosed in the accompanying claims. For example, although the present invention has been described in conjunction with a cooling function, it is not limited thereto. That is, the present invention is also applicable to the case in which a warming function is carried out using a heat pump type air conditioning system having both the cooling and warming functions. In this case, the operation state of the compressor unit is controlled by sensing a warming load caused by a decrease in room temperature occurring during a re-operation waiting time, and comparing the sensed warming load with a predetermined value. Accordingly, the warming load can be rapidly and efficiently eliminated.

As apparent from the above description, the present invention provides an air conditioning system and a method for operating the air conditioning system, which determine the amount of a cooling load generated during a waiting time for re-operation taken until the compressor unit of the system maintained in a stopped state is re-operated by calculating a temperature difference between the temperature of a room to be cooled and a desired temperature, and operate the compressor unit in a full or selective operation mode based on the determined cooling load amount, thereby being capable of preventing an unnecessary compressor operation while achieving a reduced variation in room temperature. Accordingly, it is possible to more stably control the room temperature, and to achieve an improvement in the comfortableness of the room atmosphere.

What is claimed is:

1. An air conditioning system comprising:

an air conditioner for establishing a cooling cycle adapted to sequentially perform compression, condensation, expansion and evaporation functions, and eliminating a cooling load in a room by the cooling cycle, thereby conditioning the atmosphere of the room;

a control unit for controlling an operation state of a compressor unit adapted to perform the compression function, in order to vary a refrigerant compression capacity of the compressor unit in accordance with the cooling load, wherein the air conditioner comprises:

the compressor unit including a plurality of compressors each adapted to compress a low-temperature and low-pressure gaseous refrigerant, thereby changing the refrigerant into a high-temperature and high-pressure state;

a condenser adapted to condense the high-temperature and high-pressure gaseous refrigerant, thereby changing the refrigerant into a medium-temperature and high-pressure liquid refrigerant;

an expansion valve adapted to reduce the pressure of the medium-temperature and high-pressure liquid refrigerant emerging from the condenser, thereby changing the liquid refrigerant into a low-temperature and low-pressure liquid refrigerant; and an evaporator adapted to evaporate the low-temperature and low-pressure liquid refrigerant emerging from the expansion valve, thereby changing the liquid refrigerant into a low-temperature and low-pressure gaseous refrigerant; and wherein the control unit comprises:

a counting unit senses that a point of time when the compressor unit is stopped, and counts a waiting time taken until the stopped compressor unit is re-operated;

a temperature sensing unit that senses a temperature of the room after the waiting time counted by the counting unit;

a load determining unit that determines a cooling load generated during the waiting time, based on a temperature difference between the room temperature sensed by the temperature sensing unit and a previously-input desired temperature; and a compressor controlling unit that outputs a control signal making the compressor unit operate in a full operation mode or a selective operation mode in accordance with the cooling load sensed by the load determining unit.

2. The air conditioning system according to claim 1, wherein the load determining unit determines whether or not the temperature difference is more than a predetermined value, and determines an abrupt increase in cooling load when it is determined that the temperature difference is more than the predetermined value.

3. A method for operating an air conditioning system comprising:

simultaneously operating a plurality of compressors included in the air conditioning system until a temperature of a room to be cooled reaches a predetermined temperature;

stopping the operation of the compressors when the room temperature reaches the predetermined temperature, and sensing a temperature of the room after a waiting time taken until the stopped compressors are re-operated; and simultaneously or selectively operating the compressors in accordance with a temperature difference between the room temperature sensed at the stopping and sensing and the predetermined temperature.

4. The method according to claim 3, wherein the simultaneously or selectively operating comprises:

calculating the temperature difference between the room temperature sensed at the stopping and sensing and the predetermined temperature; and determining whether or not the temperature difference calculated at the calculating is less than a predetermined value, and simultaneously or selectively operating the compressors, based on the result of the determination.

5. The method according to claim 4, wherein the determining and simultaneously or selectively operating comprises selectively operating the compressors when the temperature difference is less than the predetermined value, while simultaneously operating the compressors when the temperature difference is not less than the predetermined value.

* * * * *

UNITED STATES PATENT AND TRADEMARK OFFICE

CERTIFICATE OF CORRECTION

PATENT NO. : 6,807,815 B2
DATED : October 26, 2004
INVENTOR(S) : W.H. Lee et al.

It is certified that error appears in the above-identified patent and that said Letters Patent is hereby corrected as shown below:

Column 8,
Line 55, "senses that" should read -- that senses --.

Signed and Sealed this

Twenty-first Day of June, 2005

JON W. DUDAS
*Director of the United States Patent and Trademark Office*